219-121 SR
4/28/87 OR 4,661,676

United States Patent [19]
Morita et al.

[11] Patent Number: 4,661,676
[45] Date of Patent: Apr. 28, 1987

[54] PROCESS FOR PRODUCING CAMSHAFT WITH CAMS SUBJECTED TO REMELTING CHILLING TREATMENT

[75] Inventors: Akiyoshi Morita; Hideo Nonoyama; Toshiharu Fukuizumi; Kiyokazu Uruno, all of Toyota, Japan

[73] Assignee: Toyota Jidosha Kabushiki Kaisha, Toyota, Japan

[21] Appl. No.: 831,863

[22] Filed: Feb. 24, 1986

[30] Foreign Application Priority Data

Mar. 1, 1985 [JP] Japan ..... 60-41473

[51] Int. Cl.[4] ..... B23K 26/00

[52] U.S. Cl. ..... 219/121 LM; 219/121 EM; 219/121 PY; 219/121 FS; 219/137 R

[58] Field of Search ..... 219/121 L, 121 LM, 121 EB, 219/121 EM, 137 R, 121 P, 121 PY, 121 FS

[56] References Cited

FOREIGN PATENT DOCUMENTS 0161624 11/1985 European Pat. Off. .
2741567 3/1979 Fed. Rep. of Germany .
2839990 8/1979 Fed. Rep. of Germany .
0234167 11/1985 Japan .
0231168 11/1985 Japan .
0258426 12/1985 Japan .
2004613 4/1979 United Kingdom .
2004919 4/1979 United Kingdom .

*Primary Examiner*—C. L. Albritton
*Attorney, Agent, or Firm*—Oblon, Fisher, Spivak, McClelland & Maier

[57] ABSTRACT

A process for producing a camshaft with cams include the steps of forming a surface hardened layer in each of the cams by a remelting chilling treatment using high density energy (e.g., a TIG arc), characterized in that after the remelting chilling treatment, the camshaft is cooled by passing a cooling medium through a through hole formed longitudinally in the camshaft. As a result of the cooling, the neighboring untreated cam has a temperature of up to 250° C. Elongation of the camshaft due to thermal expansion is so small that no melt-down end portion defects appear.

7 Claims, 10 Drawing Figures

PRESENT INVENTION x 100
Hv 701

PRESENT INVENTION x 100
Hv 677

COMPARATIVE EXAMPLE x 100
Hv 670

COMPARATIVE EXAMPLE x 100
Hv 600

PROCESS FOR PRODUCING CAMSHAFT WITH CAMS SUBJECTED TO REMELTING CHILLING TREATMENT

BACKGROUND OF THE INVENTION

1. Field of the Invention

The present invention relates to a camshaft with cams, more particularly, it relates to a process for producing a camshaft with cams having a surface hardened layer formed by a remelting chilling treatment of high density energy, such as a tungsten inert gas (TIG) arc, a laser beam, plasma arc, and an electron beam, on a sliding cam surface of each cam.

2. Description of the Related Art

In the production of a camshaft, recently, irradiation of high density energy, such as a TIG arc, a laser beam, a plasma arc, and an electron beam, to a sliding cam surface of cams of a camshaft is utilized so as to form a surface hardened layer having a superior wear resistance (cf., e.g., GB-A-2004613, Japanese Examined Patent Publication (Kokoku) No. 57-6494 based on priority of DE Patent Application No. 2741567.4). The present coinventors (H. Nonoyama, T. Fukuizumi, and A. Morita) have proposed "a method of producing a camshaft", (in U.S. Ser. No. 730,484, filed on May 6, 1985, corresponding to EP-A-0161624) using high density energy irradiation. The surface hardened layer of each cam is formed by the steps of applying high density energy, e.g., a TIG arc, on a sliding cam surface to melt the irradiated portion and, immediately after irradiation, cooling rapidly the heated portion including the molten portion by dissipating localized heat through the cam and the camshaft body (i.e., allowing the heated portion to self cool), so that the surface hardened layer consists of a chilled layer and a hardened layer (i.e., a martensitic layer). In order to form the surface hardened layer on each of the cams of a camshaft, for example, an electric arc is generated between a tungsten torch and a sliding cam surface, simultaneously, the camshaft is rotated on its longitudinal axis and is reciprocated in a direction parallel to the axis of the camshaft at a distance of less than the width of the cam, and the gap between the cam and the tungsten arc torch is maintained at a constant distance. Accordingly, the arc oscillates over the cam surface and the continuously remelted zigzag bead is joined so as to form a single bead layer. It is possible to reciprocate the tungsten torch instead of the camshaft.

If the position of the cam to the tungsten arc torch is off from the prescribed position in a direction parallel to the axis of the camshaft, the obtained surface hardened layer shifts from the proper location. As a result, defects in the camshaft occur, namely, a melt-down end portion is formed at the edge of the cam, and an unhardened portion may appear on the sliding cam surface.

For production of such remelted chilled camshafts, generally, the following two processes are adopted.

First, all the cams of a camshaft are subjected to a remelting chilling treatment in a single station. In this case, plural torches for high density energy irradiation are used to treat some cams and then the torches or the camshaft are shifted to a next prescribed position for treating some other cams. Since the remelting chilling treatments are repeated for all the cams, the total time of the treatment is relatively long. When a large number of camshafts are produced, such a relative long time of the remelting chilling treatment may limit the productivity of the production line. Furthermore, if the production halts during the remelting chilling treatment, the longitudinal dimension (i.e., the overall length) of the camshaft to be treated varies due to the thermal shrinkage by cooling. When the treatment restarts, there is liable to be a melt-down end portion.

Second, plural stations, each of which has plural torches for some cams, are provided so as to form a transfer production line. The torches in the stations are arranged for the cams of a camshaft, respectively. In this case, plural camshafts are set in the plural stations, respectively, and the remelting chilling treatments in the stations are almost simultaneously carried out. Thus, the number of the produced camshafts per unit period is increased, so that the second production process is suitable for mass production. However, a cool camshafts is, generally, preheated at a temperature of approximately 400° C., and camshafts heated by the high density energy (e.g., TIG arc) are controlled to have a temperature of approximately 400° C., before the remelting chilling treatment. Since the high preheating temperature of 400° C. entails a large degree of thermal expansion in a longitudinal direction of the camshaft, a position of the torch for a cam must be controlled in consideration of the thermal expansion quantity. If the production halts, which brings about the cooling of the camshafts, the cool camshafts are subjected to a remelting chilling treatment without preheating so that melt-down end portions are liable to occur. In order to prevent the formation of melt-down end portions, a heating device or heating zones for heating or keeping the camshafts at 400° C. and a controlling system for the heating device or the heating zones are provided in the transfer production line. If necessary, a device for transporting the camshafts between the heating device and the stations for remelting chilling is also provided. Such additional devices and system complicate the production apparatus and increase the initial cost. Furthermore, concerning the quantity of the surface hardened layer of the camshaft, the chill structure of the chilled layer of the camshaft preheated at approximately 400° C. is similar to the coarse cementite structure of a chilled layer of a camshaft produced by casting molten metal into a mold provided with chillers (i.e., chilling blocks) for cams. Although a remelting chilling treatment using high density energy can form a superior fine cementite structure of a chilled layer, the preheating at approximately 400° C. prevents the formation of it. When a camshaft preheated at a temperature of more than 250° C. is subjected to the remelting chilling treatment, bainite occurs in a martenstic hardened layer under the chilled layer. The coarse cementite and bainite are insufficient to secure superior wear resistance and scuffing resistance of the surface hardened layer of cams.

SUMMARY OF THE INVENTION

An object of the present invention is to provide a process for producing camshafts with cams having no melt-down end portions and a superior surface hardened layer.

Another object of the present invention is to provide a process for producing camshafts for mass production.

These and other objects of the present invention are attained by a process for producing camshafts with cams comprising steps of forming a surface hardened layer in each of the cams by a remelting chilling treatment using high density energy, such as a TIG arc, a laser beam, a plasma arc, and an electron beam, applied on a sliding cam surface of each cam. According to the present invention, after the remelting chilling treatment for at least one of the cams and prior to the next remelting chilling treatment for another cam, the camshaft is cooled by passing a cooling medium through a through hole formed longitudinally in the camshaft.

The camshaft is cooled so that the other cam has a temperature of up to 250° C., preferably, room temperature −150° C. by using a cooling liquid (e.g., water) or a spray of the cooling liquid.

BRIEF DESCRIPTION OF THE DRAWINGS

The present invention will become more apparent from the description of the preferred embodiments set forth below with reference to the accompanying drawings, in which.

DESCRIPTION OF THE PREFERRED EMBODIMENTS

Figure 1:
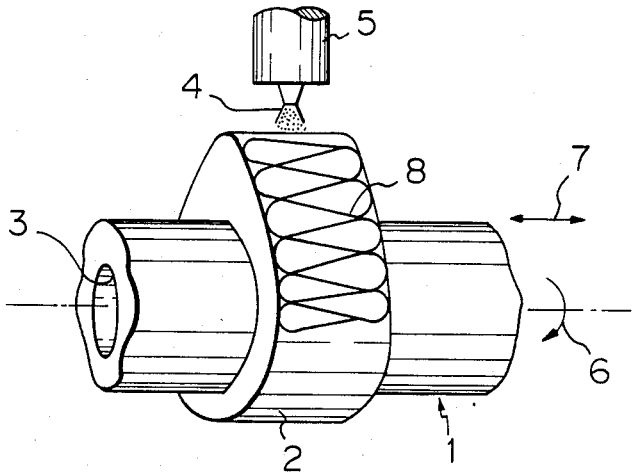
FIG. 1 is a schematic view of a cam of a camshaft and a TIG arc torch.

Referring to FIG. 1, a remelting chilling treatment using high density energy (e.g., a TIG arc) will be now explained.

Figure 2:
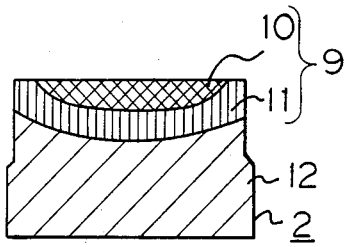
FIG. 2 is a sectional partial view of a cam having a normal surface hardened layer.

A camshaft 1 having cams 2 and a main oil bore (i.e., a through hole) 3 in a longitudinal direction is made of cast iron and machined. A TIG arc 4 is generated between the cam 2 and a TIG arc torch 5 so as to locally melt the surface (i.e., the sliding surface) of the cam 2. When the arc 4 is generated, the camshaft is rotated on its longitudinal axis in a direction 6 and is reciprocated in a direction 7 parallel to its longitudinal axis, and simultaneously, the gap between the cam 2 and the torch 5 is maintained at a constant distance. Accordingly, the arc 4 oscillates over the cam surface to form a continuous bead 8 of a melted and solidified portion of the cam 2. Directly after the movement of the TIG arc 4, the molten portion and the heated portion of the cam 2 which are formed by TIG arc energy are rapidly cooled by dissipation of the localized heat through the camshaft itself (i.e., so-called self-cooling). As a result, a surface hardened layer 9 consisting of a chilled layer 10 of cementite and a hardened layer 11 of martensite is formed, as shown in FIG. 2. Reference numeral 12 indicates an as-cast portion of the cast iron cam 2.

Figure 3:
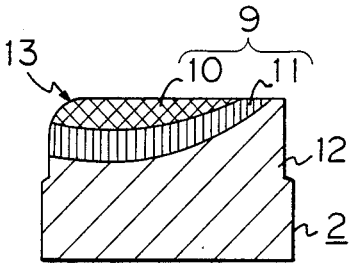
FIG. 3 is a sectional partial view of a cam having a surface hardened layer including a melt-down end portion.

As the remelting chilling treatment for a cam is repeated for all the cams of a camshaft, the temperature of the camshaft rises by means of TIG arc heating. Due to thermal expansion of the camshaft, its overall length extends. The TIG arc torches are arranged in consideration of the thermal expansion quality. If a cam of a camshaft having a large different thermal expansion quality from its given value is subjected to the remelting chilling treatment, a position of the cam to be treated is shifted so that an end portion 13 of the cam 2 is melted down, as shown in FIG. 3.

According to the present invention, after the remelting chilling treatment, a camshaft is cooled by passing a cooling medium through a through hole (a main oil bore) formed longitudinally in the camshaft.

Figure 4:
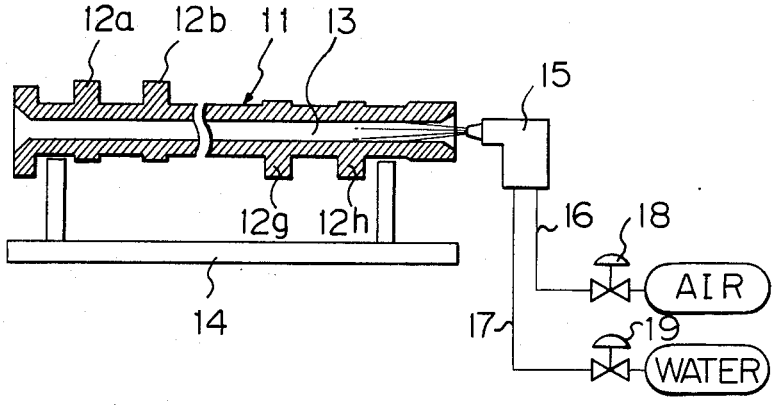
FIG. 4 is a schematic view of a cooling system for a camshaft.

Referring to FIG. 4, a camshaft 11 having cams 12*a*, 12*b*, . . . 12*g*, and 12*h* and a main oil bore 13 is set on a stand 14 of a cooling station. In this case, each of the cams 12*a*–12*h* has no oil hole communicating with the main oil bore 13 at a base circle portion of the cam. A nozzle 15 for feeding a stream of fluid into the main oil bore 13 is arranged and is connected with a pipeline 16 for compressed air and a pipeline 17 for water. The pipelines 16 and 17 are provided with control valves 18 and 19, respectively.

EXAMPLE 1

A camshaft 11 with eight cams 12*a*–*12h* of cast iron has the following dimensions: camshaft length, 420 mm; diameter of shaft portion, 24 mm; diameter of main oil bore 13, 8 mm; cam width, 10 mm; lifting height, 8 mm. First, the cam 12*a* is subjected to the remelting chilling treatment using a TIG arc under the following conditions.

Preheating of camshaft: None
DC current: 80 A
DC voltage: 17 V
Camshaft rotation speed: 1 rpm
Camshaft reciprocation speed: 50 oscillations per minute
Oscillation width of camshaft: 5 mm Immediately after the remelting chilling treatment, the camshaft 11 is put on the stand 14 of the cooling station, as shown in FIG. 4. Then, water is atomized by compressed air by means of the nozzle 15 so as to pass the spray through the bore 13 under conditions (water pressure, 1.5 kg/cm$^2$; air pressure, 1.5 kg/cm$^2$, and spraying time, 50 seconds). After the spraying, compressed air only is fed for 10 seconds so as to flow remaining water drops off. Thus, the camshaft is cooled. Immediately, the temperature of the neighboring cam 12*b* the total length of the camshaft 11 are measured. The temperature of the cam 12*b* is 30° C. at a room temperature of 25° C., and the elongation of the camshift is 0.04 mm.

Then, the camshaft 11 is reset in a station for the remelting chilling treatment, and the second cam 12*b* is subjected to the remelting chilling treatment under the above-mentioned conditions. The camshaft 11 is cooled under the above-mentioned conditions. As a result, the temperature of the third cam 12*c* is 40° C., and the elongation is 0.06 mm.

The above-mentioned treatment and cooling are repeated for the remaining cams 12*c* to 12*g*, respectively. As a result, the temperature of the cam 12*h* is 50° C., and the elongation of the camshaft is 0.14 mm.

It is possible to feed water without compressed air into the main oil bore.

The elongation of the camshaft due to thermal expansion can be substantially suppressed, so that melt-down end portion defects do not occur. Since the temperature of the cam is low prior to the remelting chilling treatment, the obtained surface hardened layer has superior properties in wear resistance and scuffing resistance.

Furthermore, the camshaft is wholly cooled by a cooling medium flowing through the through hole, so that a wanpage of the center axis of the camshaft is very small.

Figure 5:
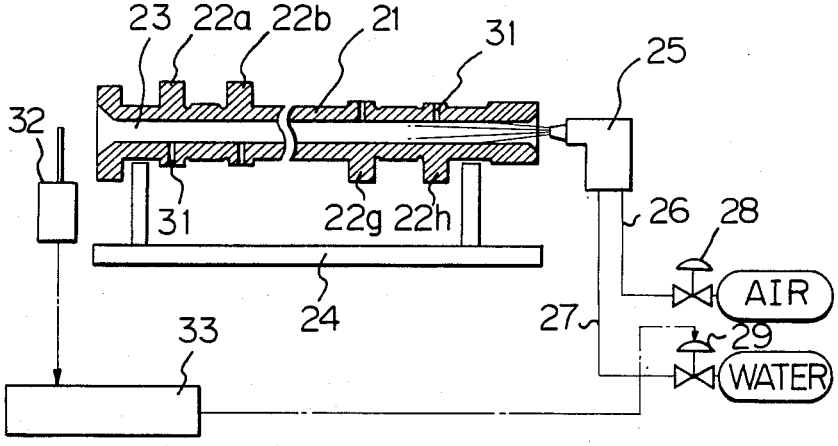
FIG. 5 is a schematic view of a cooling system for a camshaft comprising a temperature sensor.

Referring to FIG. 5, a camshaft 21 having cams 22*a*, 22B, . . . 22*g*, and 22*h* and a main oil bore 23 is set on a stand 24 of a cooling station. In this case, each of the cams 22*a*–22*h* has an oil hole 31 communicating at a base circle portion of the cam. In order to pass the cooling medium through the main oil bore 23, a nozzle 25, a pipeline 26 for compressed air, a pipeline 27 for water, and control valves 28 and 29 are provided. Furthermore, a temperature sensor 32 is arranged in front of the bore 23 at the exit side, and a controlling device 33 is connected with the sensor 32 and the control valve 29.

EXAMPLE 2

A camshaft 21 with eight cams 22*a*–22*h* of cast iron has the following dimensions: camshaft length, 380 mm; diameter of shaft portion, 28 mm; diameter of main oil bone 23, 8 mm; can width, 14.5 mm; lifting height, 7 mm. Each of the cams 22*a*–22*h* has an oil hole 31 for a lubricant at the base circle portion thereof.

The camshaft 21 is brought into a production line comprising four stations for the remelting chilling treatment and three cooling stations sandwiched between the treating stations. Each of the treating stations is provided with two TIG arc torches and each of the cooling stations comprises the above-mentioned parts, e.g., stand 24, nozzle 25, pipelines 26 and 27, control valves 28 and 29, sensor 32, and controlling device 33. The production line has no preheating station or device.

First, the cams 22*a* and 22*e* (not shown) are simultaneously subjected to the remelting chilling treatment in the first treating station under the following conditions.

DC current for pulsed arc:
Pulsed peak current: 120 A
Base current: 110 A
Camshaft rotation speed: 0.9 rpm
Camshaft reciprocation speed: 50 oscillations per minute
Oscillation width of camshaft: 10.0 mm The amount of heat received by the camshaft 21 is approximately 35 kcal (146 kJ), and the average temperature of the camshaft is 150° C., which are measured by a water calorimeter. The longitudinal of the camshaft 21 due to the thermal expansion is 0.7 mm.

Figure 6:
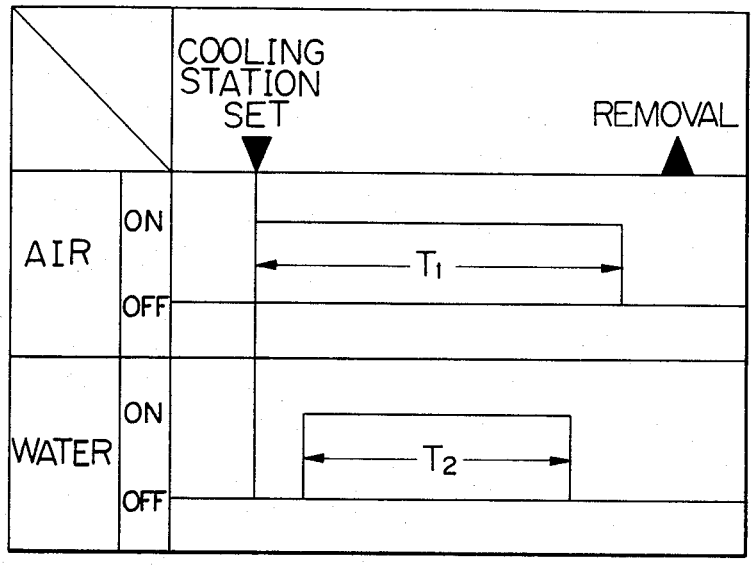
FIG. 6 is a diagram showing an ON-OFF schedule of feeding air and water.
Figure 7A:
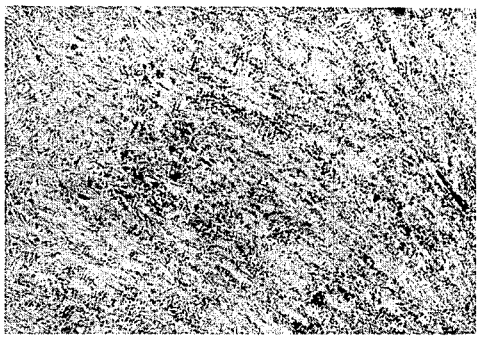
FIG. 7*a* is a microscopic photograph of a chilled layer of a cam treated in accordance with the process of the present invention at a starting portion of a TIG arc.
Figure 7B:
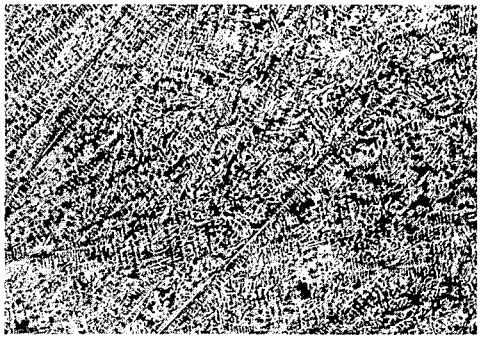
FIG. 7*b* is a microscopic photograph of a chilled layer at a cam-nose portion of a cam treated in accordance with the process of the present invention.

Immediately after the remelting chilling treatment, the camshaft 21 is transferred into the first cooling station from the first treating station. When the camshaft 21 is set on the station 24, compressed air having an air pressure of 1.5 kg/cm$^2$ flows through the main oil bore 23 from the nozzle 25. Then the temperature of the air blowing off from the bore 23 and heated by the camshaft's heat is measured by the sensor 32. The air temperature conveniently indicates the amount of heat held by the camshaft or the temperature of the camshaft. The signal of temperature is sent to the controlling device 33 from the sensor 32. The controlling device 33 determines a period $T_2$ of water flow, as shown in FIG. 6, based on the temperature information. The controlling device 33 sends an output signal for opening the valve 29 and then another output signal for closing the valve 29. The fed water having a water pressure of 1.0 kg/cm$^2$ is atomized by the compressed air so as to pass the spray through the bore 33. A period $T_1$ of air blowing is longer than the period $T_2$, as shown in FIG. 6. The compressed air only is fed so as to blow remaining water drops off. Thus, the camshaft 21 is so cooled that the neighboring untreated cam has a given temperature of from room temperature to 250° C., preferably, from room temperature to 150° C. In the case where the period $T_1$ is 65 seconds and the period $T_2$ is about 55 seconds, the temperature of the untreated cam 22*b* is 100° C., and the elongation of the camshaft is 0.15 mm.

If the cooling of the camshaft brings the temperature of the untreated cam down to 50° C. or below, water drops may remain with the oil holes 31, since the water drops are not evaporated. When the untreated cam is subjected to the remelting chilling treatment at the second treating station, the water drops are evaporated by the TIG arc heat to sport as steam from the oil hole 31. The steam oxidizes an electrode of a TIG arc torch so that an undesirable arc blow may occur, i.e., the TIG arc is irregularly generated. As a result, melt-down end portion defects may appear, and close control of the TIG arc position cannot be performed.

Furthermore, if, after the remelting chilling treatment, the untreated cam has a temperature of 50° C. or less, it is unnecessary to open the valve for feeding water. Such operation can be determined by the controlling device 33.

The above-mentioned operations at the first treating station and the first cooling station are repeated at the remaining stations, respectively. When the camshaft 21 leaves the third cooling station, the elongation of the camshaft can be controlled from 0 to 0.5 mm. Such elongation is so small that no melt-down end portion defects appear. The camshaft can be transferred from one of the stations to the neighboring station at constant intervals of 75 seconds. The production line is suitable for mass production of the camshafts. Furthermore, since a preheating device is unnecessary and water of a cooling medium can increase the cooling efficiency, the production line for carrying out the process of the present invention can be made compact, for saving space.

The camshaft produced in the production line was assembled in an engine and was tested for 200 hours on scuffing resistance. For comparison, a camshaft produced by using chillers for cams and a camshaft produced by adopting preheating at 400° C. before the remelting chilling treatment were assembled in engines, respectively, and were tested under the same conditions. The obtained test results are shown in Table 1.

TABLE 1

| Camshaft | Wear amount at cam nose portion (μm) | Estimated scuffing | Integral estimation |
|---|---|---|---|
| Present invention | 10–40 | 10 | Superior |
| (Comparative example) | | | |
| Preheating | 50–80 | 7–9 | Normal |
| Using chillers | 60–100 | 6–8 | Inferior |

The degree of scuffing defects generated on the sliding cam surface is indicated in steps of an index of from "0" to "10" in the "estimated scuffing" column of Table 1. The index of "10" indicates the best resistance to scuffing and the index of "0" indicates the worst resistance to scuffing.

As is evident from Table 1, the camshaft produced in accordance with the process of the present invention has a superior scuffing resistance and a superior wear resistance as compared with the other camshaft of the comparative examples.

Figure 8A:
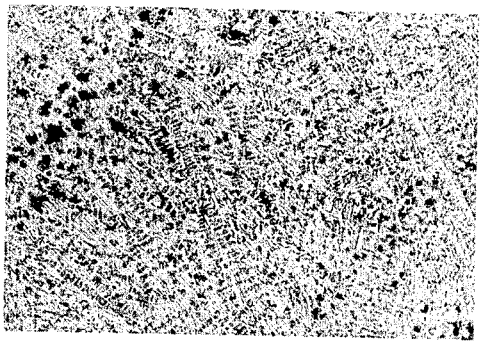
FIG. 8*a* is a microscopic photograph of a chilled layer of a preheated cam at a starting position of a TIG arc.
Figure 8B:
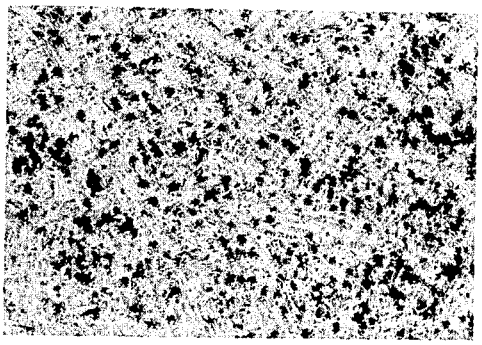
FIG. 8*b* is a microscopic photograph of a chilled layer of a cam-nose portion of a preheated cam.

Furthermore, metal structures and hardnesses of chilled layers of cam subjected to the remelting chilling treatment are shown in microscopic photographs of FIG. *7a, 7b,* 8*a* and 8*b*. FIGS. *7a* and *7b* were obtained from a cam of the camshaft produced in accordance with the process of the present invention. FIG. *7a* shows a chill structure of a portion in which a TIG arc is started and which has a Vickers Hardness of 701. FIG. *7b* shows a chill structure of a cam nose portion having a Vickers Hardness of 677. FIGS. 8*a* and 8*b* were obtained from a cam of the camshaft produced by adopting preheating at 400° C. FIG. 8*a* shows a chill structure of a portion in which a TIG arc is started and which has a Vickers Hardness of 670. FIG. 8*b* shows a chill structure of a cam nose portion having a Vickers Hardness of 600.

As is evident from FIGS. *7a, 7b,* 8*a,* and 8*b,* the cam of the camshaft according to the present invention has a finer chill structure and a higher hardness as compared with the cam of the camshaft of the comparative example.

It will be obvious that the present invention is not restricted to the above-mentioned embodiments and that many variations are possible for persons skilled in the art without departing from the scope of the invention.

We claim:

1. A process for producing camshafts with cams, comprising the steps of forming a surface hardened layer in each of said cams by a remelting chilling treatment using high density energy, such as a TIG arc, a laser beam, a plasma arc, and an electron beam, applied on a sliding cam surface of each cam, characterized in that after said remelting chilling treatment with the high density energy for at least one of said cams and prior to the next remelting chilling treatment with the high density energy for other cams, said camshaft is cooled by passing a cooling medium through a through hole formed longitudinally in said camshaft.

2. A process according to claim 1, wherein said cooling medium is one selected from the group consisting of a cooling liquid or a spray of the cooling liquid.

3. A process according to claim 2, wherein said cooling liquid is water.

4. A process according to claim 3, wherein said spray of water is formed by the aid of compressed gas.

5. A process according to claim 4, wherein said compressed gas is compressed air.

6. A process according to claim 1, wherein said camshaft is cooled so that said other cam has a temperature of up to 250° C.

7. A process according to claim 6, wherein said camshaft is cooled so that said other cam has a temperature of up to 150° C.

* * * * *